US007062857B1

(12) United States Patent
Nenadic

(10) Patent No.: US 7,062,857 B1
(45) Date of Patent: Jun. 20, 2006

(54) KNIFE WITH BLADE LOCK AND LANYARD LOCK

(75) Inventor: John Nenadic, Tivoli, NY (US)

(73) Assignee: Taylor Cutlery LLC, Kingsport, TN (US)

( * ) Notice: Subject to any disclaimer, the term of this patent is extended or adjusted under 35 U.S.C. 154(b) by 0 days.

(21) Appl. No.: 10/278,385

(22) Filed: Oct. 23, 2002

(51) Int. Cl.
*B26B 3/06* (2006.01)

(52) U.S. Cl. ..... 30/161; 30/298.4

(58) Field of Classification Search ..... 30/160, 30/161, 298.4
See application file for complete search history.

(56) References Cited

U.S. PATENT DOCUMENTS

| | | | | |
|---|---|---|---|---|
| 1,030,058 | A | 6/1912 | Doles | |
| 1,189,005 | A | 6/1916 | Seely | |
| 1,443,701 | A * | 1/1923 | Comstock | 30/161 |
| 1,603,914 | A | 10/1926 | Hermann | |
| 1,667,462 | A | 4/1928 | Logan | |
| 2,188,762 | A | 1/1940 | Schrade | |
| 2,596,294 | A | 5/1952 | Schrade | |
| 2,839,831 | A * | 6/1958 | Baer | 30/298.4 |
| 3,868,774 | A | 3/1975 | Miori | |
| 4,099,327 | A | 7/1978 | Pesa | |
| 4,233,737 | A | 11/1980 | Poehlmann | |
| 4,240,201 | A | 12/1980 | Sawby et al. | |
| 4,274,200 | A | 6/1981 | Coder | |
| 4,302,877 | A * | 12/1981 | Hart et al. | 30/161 |
| 4,442,559 | A * | 4/1984 | Collins | 30/153 |
| 4,451,982 | A | 6/1984 | Collins | |
| 4,502,221 | A | 3/1985 | Pittman | |
| 4,563,813 | A * | 1/1986 | Fortenberry | 30/161 |
| 4,670,984 | A | 6/1987 | Rickard | |
| 4,719,700 | A | 1/1988 | Taylor, Jr. | |
| 4,811,486 | A | 3/1989 | Cunningham | |
| 4,837,932 | A | 6/1989 | Elsener | |
| 4,896,424 | A | 1/1990 | Walker | |
| 4,974,323 | A | 12/1990 | Cassady | |
| 5,029,355 | A | 7/1991 | Thai | |
| 5,060,379 | A | 10/1991 | Neely | |
| 5,095,624 | A | 3/1992 | Ennis | |
| 5,111,581 | A | 5/1992 | Collins | |
| 5,349,753 | A * | 9/1994 | Gaffney | 30/160 |
| 5,425,175 | A | 6/1995 | Rogers | |
| 5,450,670 | A * | 9/1995 | Sakai | 30/298.4 |
| 5,461,786 | A | 10/1995 | Miller | |
| 5,495,673 | A * | 3/1996 | Gardiner et al. | 30/155 |

(Continued)

FOREIGN PATENT DOCUMENTS

| | | |
|---|---|---|
| FR | 1042065 | 10/1953 |

(Continued)

*Primary Examiner*—Timothy V. Eley
*Assistant Examiner*—Jason Prone
(74) *Attorney, Agent, or Firm*—Blank Rome LLP

(57) ABSTRACT

The present invention is directed to a knife with a handle, a blade pivotally coupled to the handle, and a lanyard releasably coupled to the handle. The handle includes two panels that define a blade cavity for receiving a portion of the blade in an initial closed position. The knife further includes a pivotal blade locking arm and a pivotal lanyard locking arm. The blade is locked by selectively moving a portion of the blade locking arm into and out of a locking recess on the blade. The blade locking arm is an open frame. Preferably, the lanyard locking arm is disposed within the open frame of the blade locking arm. The lanyard locking arm can be moved to release the lanyard from the handle by squeezing the blade inward into the handle. The blade locking feature and the lanyard locking feature can be used alone or in combination.

14 Claims, 13 Drawing Sheets

U.S. PATENT DOCUMENTS

| | | | | | |
|---|---|---|---|---|---|
| 5,495,674 | A | | 3/1996 | Taylor, Jr. | |
| 5,615,484 | A | | 4/1997 | Pittman | |
| 5,685,079 | A | | 11/1997 | Brothers et al. | |
| 5,692,304 | A | | 12/1997 | Campbell | |
| 5,727,319 | A | * | 3/1998 | Myerchin et al. | 30/123 |
| 5,737,841 | A | | 4/1998 | McHenry et al. | |
| 5,755,035 | A | | 5/1998 | Weatherly | |
| 5,769,094 | A | | 6/1998 | Jenkins, Jr. et al. | |
| 5,822,866 | A | | 10/1998 | Pardue | |
| 5,822,867 | A | * | 10/1998 | Sakai | 30/298.4 |
| 5,915,792 | A | | 6/1999 | Sakurai | |
| 5,966,816 | A | * | 10/1999 | Roberson | 30/161 |
| 6,029,357 | A | * | 2/2000 | Morton | 30/298.4 |
| 6,122,829 | A | | 9/2000 | McHenry et al. | |
| 6,125,543 | A | * | 10/2000 | Jhones | 30/161 |
| 6,134,788 | A | * | 10/2000 | Chen et al. | 30/161 |
| 6,370,778 | B1 | | 4/2002 | Conable | |
| 6,378,214 | B1 | | 4/2002 | Onion | |
| 6,402,763 | B1 | * | 6/2002 | Scott | 30/155 |
| 6,427,335 | B1 | | 8/2002 | Ralph | |
| 6,430,816 | B1 | | 8/2002 | Neveux | |
| 6,438,848 | B1 | | 8/2002 | McHenry et al. | |
| 2004/0231163 | A1 | * | 11/2004 | Sakai | 30/161 |

FOREIGN PATENT DOCUMENTS

| | | | |
|---|---|---|---|
| FR | 2403874 | | 4/1979 |
| FR | 2 403 874 | * | 5/1979 |
| GB | 740133 | | 11/1955 |
| GB | 1 576 500 | * | 10/1980 |

* cited by examiner

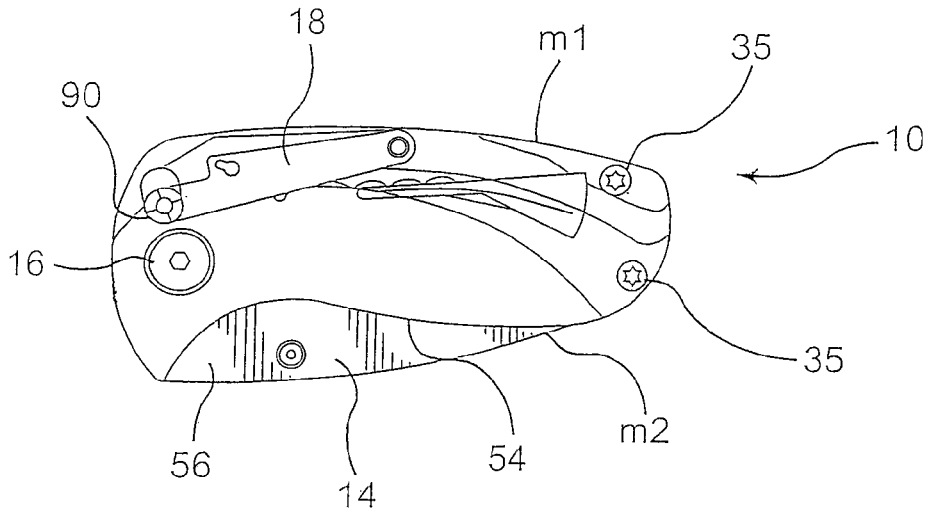
FIG.1
FIG. 1A
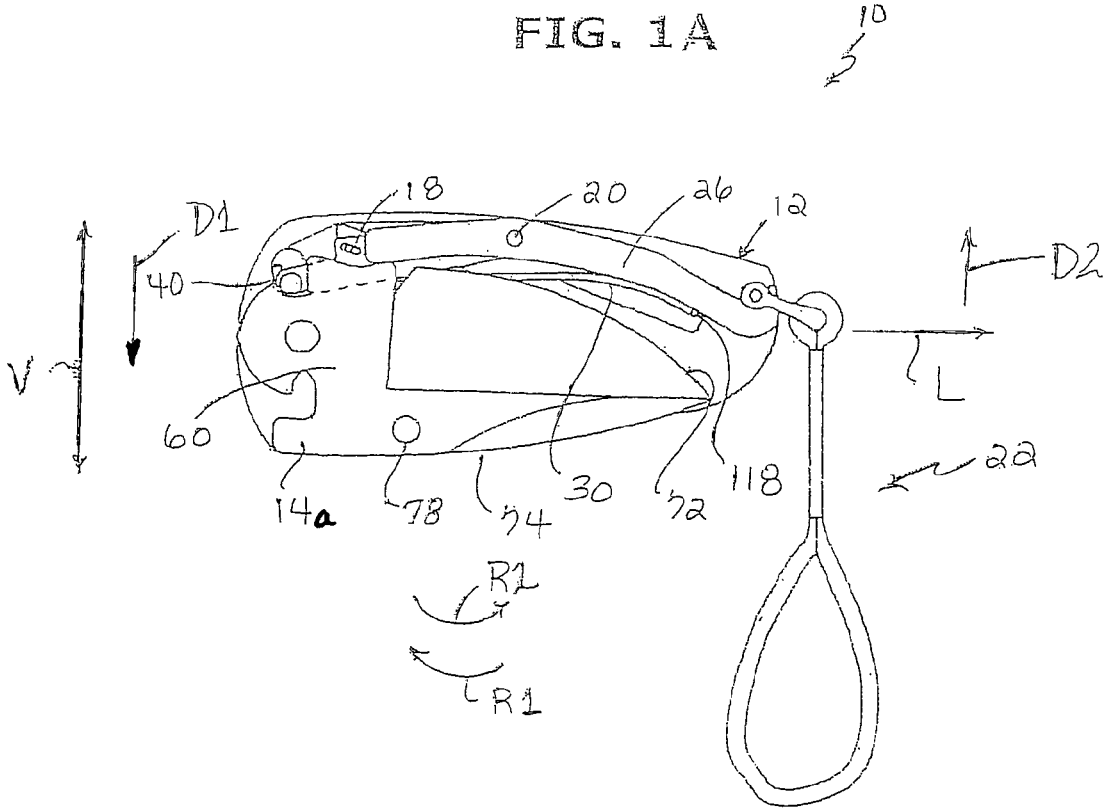

FIG. 2
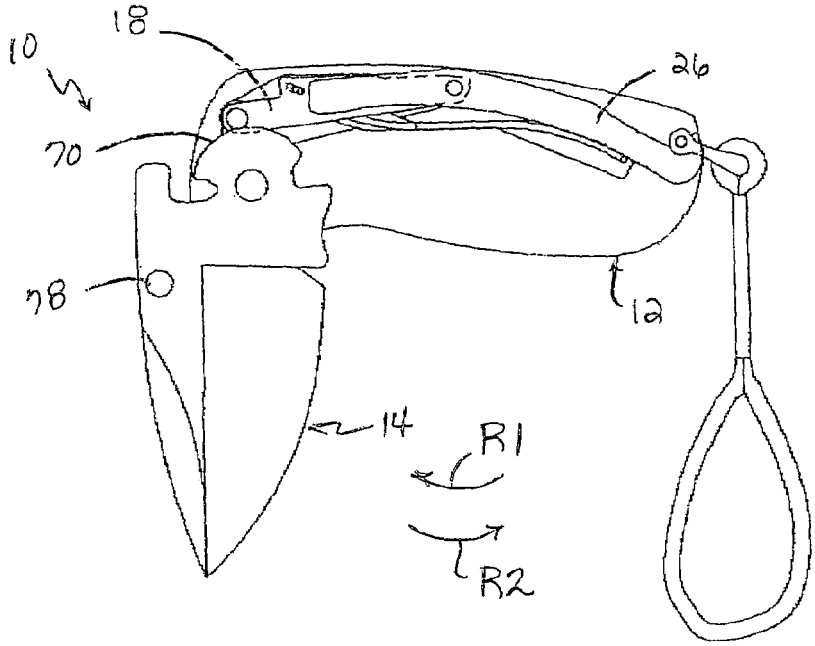
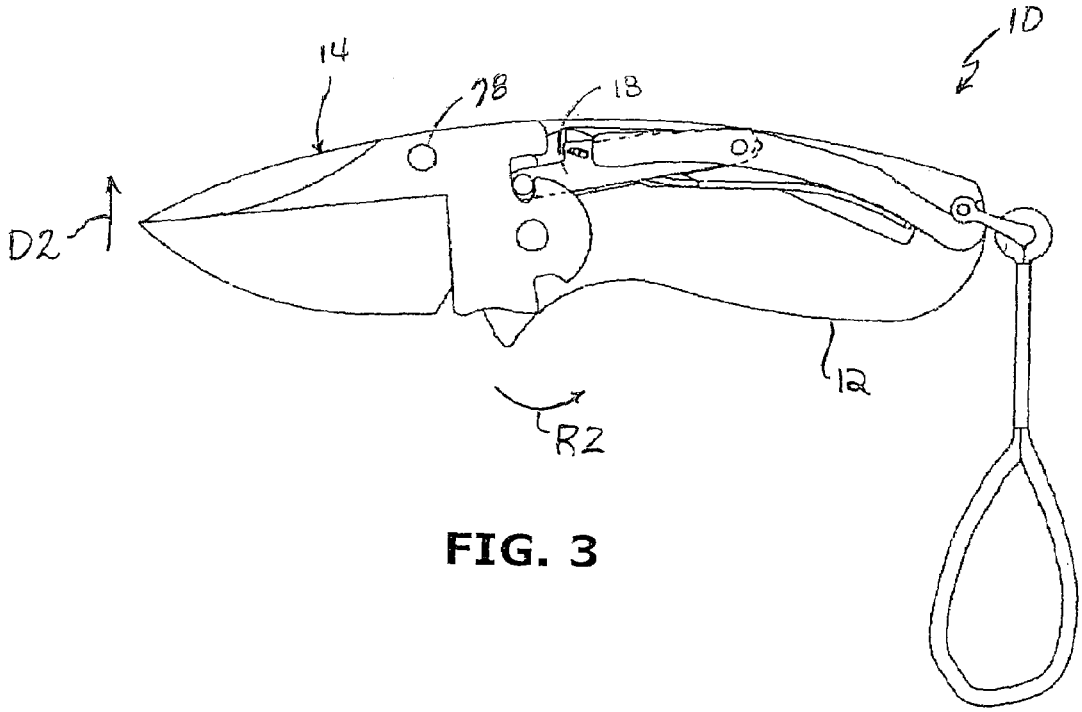
FIG. 3

FIG. 8A
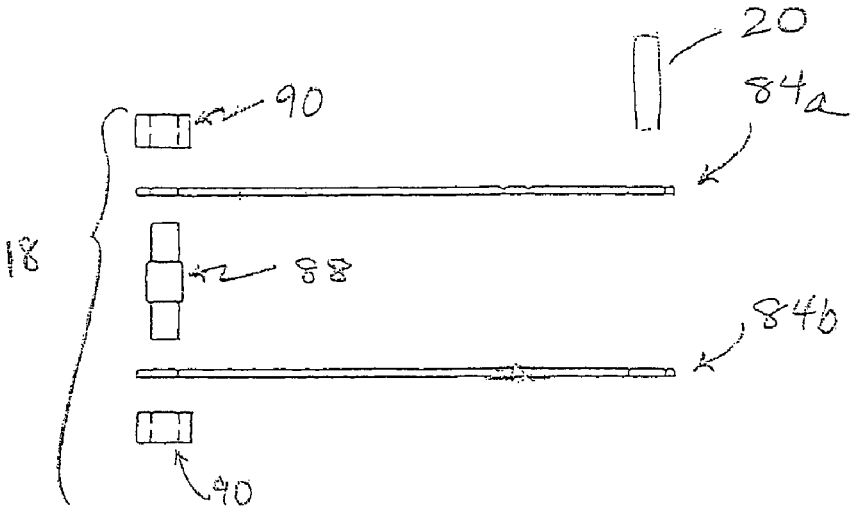
FIG. 8B
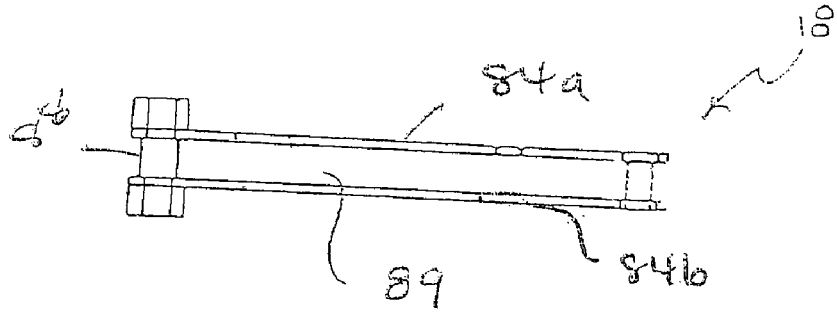
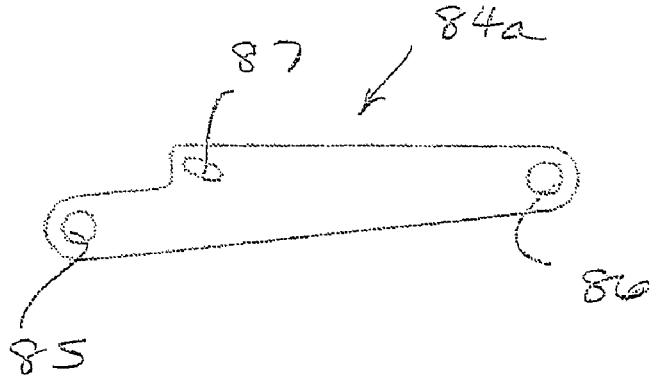
FIG. 9

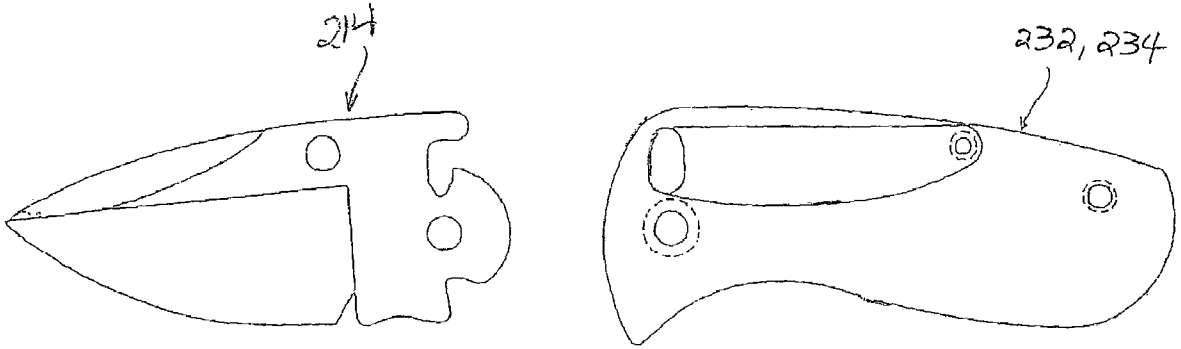
FIG. 15
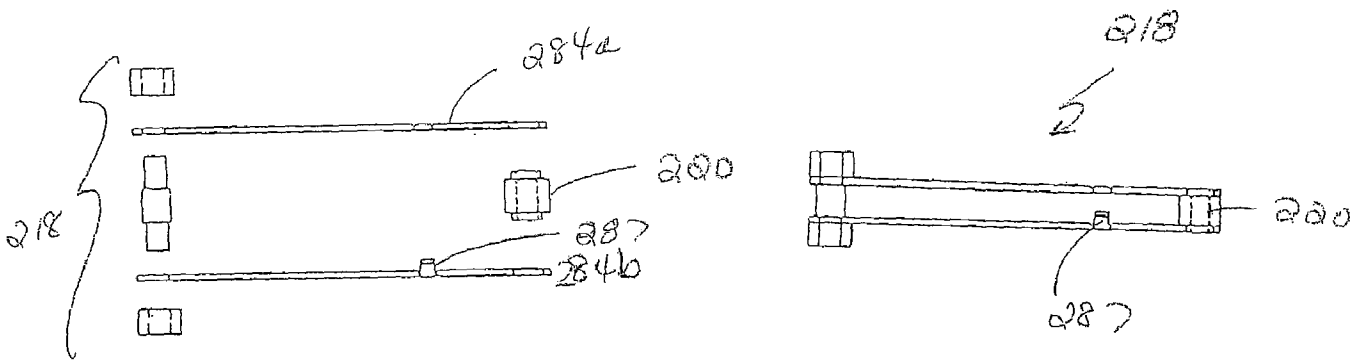
FIG. 16
FIG. 17

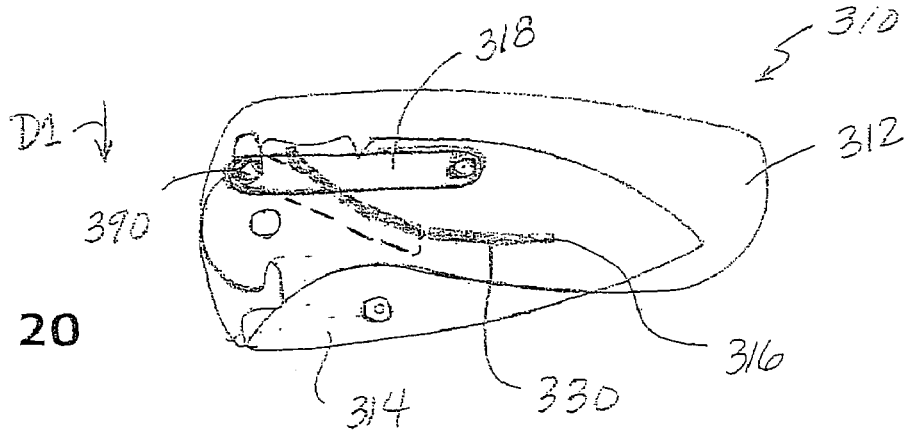
FIG. 20
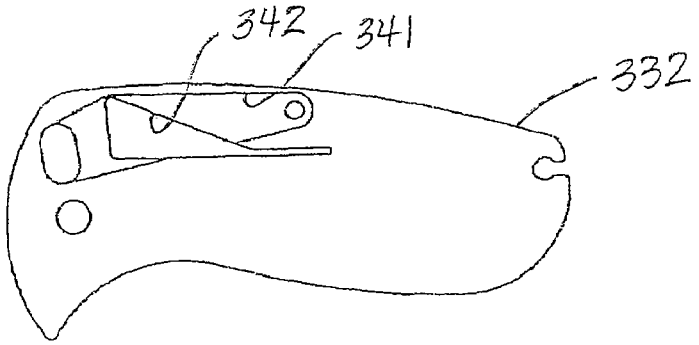
FIG. 21
FIG. 22
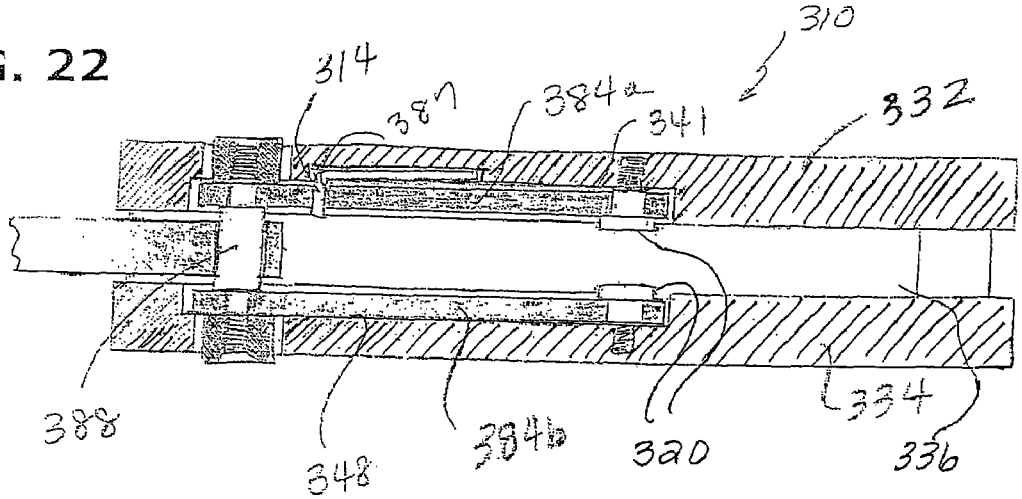

KNIFE WITH BLADE LOCK AND LANYARD LOCK

BACKGROUND OF THE INVENTION

1. Field of the Invention

This invention relates to a folding knife and, more particularly, to a folding knife including a blade locking feature and/or a lanyard locking feature.

2. Description of Related Art

Folding knives are well known. Typically such knives include a blade pivotally coupled to a handle. These knives can be of several types. One type of folding knife includes a handle with a single panel. Another type of folding knife, which is related to the present invention, includes a handle with at least two panels defining a blade cavity therebetween. When the blade is in the closed position, a portion of the blade is nested in the blade cavity to prevent a user from being able to contact the blade's cutting edge in the closed position.

Lock-back locking mechanisms for such knives that secure the blades in an open position are well known. Lock-back locking mechanisms typically include a locking member pivotally joined to the handle and disposed within the blade cavity. Such a locking member has a first end in selective locking engagement with a portion of the blade. Since this locking member usually extends the length of the handle and is disposed within the blade cavity, the size of the locking member limits the size of the blade that can be nested therein.

One locking knife is disclosed in U.S. Pat. No. 5,737,841 to McHenry et al. The McHenry et al. knife has a handle with a pair of outer plates and inner liners. The knife further includes a sliding locking assembly with a substantial portion disposed between one outer plate and one inner liner. A spring for biasing the locking assembly toward the blade is disposed between the other outer plate and inner liner.

U.S. Pat. No. 6,370,778 to Conable discloses a knife with a pivotal locking member. The locking member includes a body portion that extends within the blade cavity. The locking member is biased toward the blade with a spring.

U.S. Pat. No. 6,122,829 to McHenry et al. discloses a knife with a handle including a pair of outer plates and inner liners. A sliding locking assembly extends through the handle, and a spring for biasing the locking assembly toward a blade is disposed between the each set of outer plates and inner liners.

A commercially available knife manufactured by SOG Specialty Knives Inc. has an Arc-Lock™ feature. The Arc-Lock includes two U-shaped springs on either side of a pivotal locking member. The springs bias the locking member into contact with the blade. The locking member is a solid piece disposed within the blade cavity.

Many knives include an opening for accepting a ring or loop for connecting the knife to a lanyard. Whether a ring is used to couple the lanyard and knife, or the lanyard is connected directly to the knife through the opening, in such arrangements the knife and lanyard may not be quickly and easily separated and reconnected.

SUMMARY OF THE INVENTION

The present invention was developed in an effort to provide a knife with a blade locking feature that uses a minimal amount of blade cavity volume. Additionally, the present invention was developed to make a lanyard and handle easily connectable and separable.

The present invention is a folding knife that comprises a handle, a blade, a blade locking arm, and a spring. The handle has a first panel and a second panel connected in a spaced apart arrangement to define a blade cavity therebetween. The first panel has an inner surface with a recess defined therein. The blade is pivotally joined to the handle. The blade includes a rear edge with a locking recess. The blade locking arm includes a first member and a second member. The first member is pivotally joined to the first panel and is disposed within the recess such that a substantial portion of the first member is outside of said blade cavity. The second member is connected to the first member such that the second member extends transversely across the blade cavity. The spring is coupled to the handle. The spring biases the second member of the blade locking arm into contact with the rear edge of the blade, wherein when the blade is pivoted into a fully-open position, the second member is disposed within the locking recess.

According to one aspect of the present invention, the spring is a connected to the first panel to bias the blade locking arm. According to another aspect of the present invention, the second member is the only portion of the locking arm within the blade cavity.

In one embodiment the first panel further includes a spring recess for receiving at least a portion of the spring such that the portion of the spring is outside of the blade cavity.

The present invention is also directed to a folding knife that comprises a handle, a blade, a blade locking arm, and a spring. In this invention, the handle defines a blade cavity therebetween and the blade is pivotally joined to the handle. The blade includes a rear edge with a locking recess. The blade locking arm includes a pair of first members spaced apart to define a locking arm cavity therebetween. The blade locking arm also includes a second member that is disposed between and coupled to the pair of first members. As a result, the blade locking arm is an open frame. The first members are pivotally joined to the handle. The spring is coupled to the handle. The spring biases the second member of the blade locking arm into contact with the rear edge of the blade, wherein when the blade is pivoted into a fully-open position, the second member is disposed within the locking recess.

According to one aspect of the present invention, the first and second panels further include first and second recesses, respectively. These recesses are configured and dimensioned to receive a substantial portion of each of the first members so that the substantial portion of each of the first members is outside of the blade cavity.

Preferably in one embodiment, the first and second panels further include first and second bores, respectively, therethrough. The blade locking arm further includes a pair of knobs coupled to the first panels and extending outwardly therefrom through each associated bore.

According to one aspect of the present invention, the knife further includes a selectively releasable lanyard. The lanyard is connected to a lanyard coupling and a lanyard locking arm pivotally coupled to the handle and disposed between the pair of first members. The lanyard locking arm having a first portion and a spaced second portion. The second portion has a locking portion for retaining the lanyard coupling to the handle in a locked position. Upon moving the blade toward the lanyard locking arm, the blade contacts the first portion of the lanyard locking arm and the lanyard locking arm pivots. Consequently, the second portion moves in a second direction opposite the first direction, whereby the lanyard locking arm moves to an unlocked position where the lanyard coupling may separate from the handle.

In such an embodiment, preferably, the spring contacts the lanyard locking arm and biases the lanyard locking arm into the locked position.

Additionally, the present invention is directed to a folding knife that comprises a handle, a blade, a selectively releasable lanyard connected, and a lanyard locking arm.

Furthermore, the present invention is directed to a folding knife that comprises a handle, a blade, a blade locking arm, a selectively releasable lanyard, and a lanyard locking arm.

According to one embodiment, the knife further includes at least one spring for biasing the blade locking arm into contact with the blade. At least one spring may also be used for biasing the lanyard locking arm toward a locked position.

According to one aspect of the invention, the blade locking arm is an open frame.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which:

FIG. 1 is a side view of a first preferred embodiment of a folding knife of the present invention; wherein a blade is in a closed position and a lanyard is attached to the knife;

FIG. 1A is a side view of the knife of FIG. 1, wherein various portions are removed for clarity;

FIG. 2 is a side view of the knife of FIG. 1A, wherein the blade is in a partially-open position and the lanyard is attached to the knife;

FIG. 3 is a side view of the knife of FIG. 1A, wherein a blade is in a fully-opened position and locked and the lanyard is attached to the knife;

FIG. 8A is an exploded, enlarged, top view of a blade locking arm used in the knife of FIG. 1;

FIG. 8B is an enlarged, top view of a blade locking arm of FIG. 8;

FIG. 9 is an enlarged, side view of a first member of the blade locking arm of FIG. 8A;

FIG. 15 is an exploded, top view of the knife of FIG. 13 showing the blade and a first handle panel;

FIG. 16 is an enlarged, exploded top view of a blade locking arm used in the knife of FIG. 13;

FIG. 17 is an enlarged, top view of the locking arm of FIG. 16;

FIG. 20 is a side view of a preferred third embodiment of a knife of the present invention, wherein the blade is in a closed position and a forward handle panel is broken away for clarity;

FIG. 21 is a side view of a handle panel of the knife of FIG. 20; and

FIG. 22 is an enlarged, top view of a portion of the knife of FIG. 20.

DETAILED DESCRIPTION OF THE PREFERRED EMBODIMENTS

Figure 4:
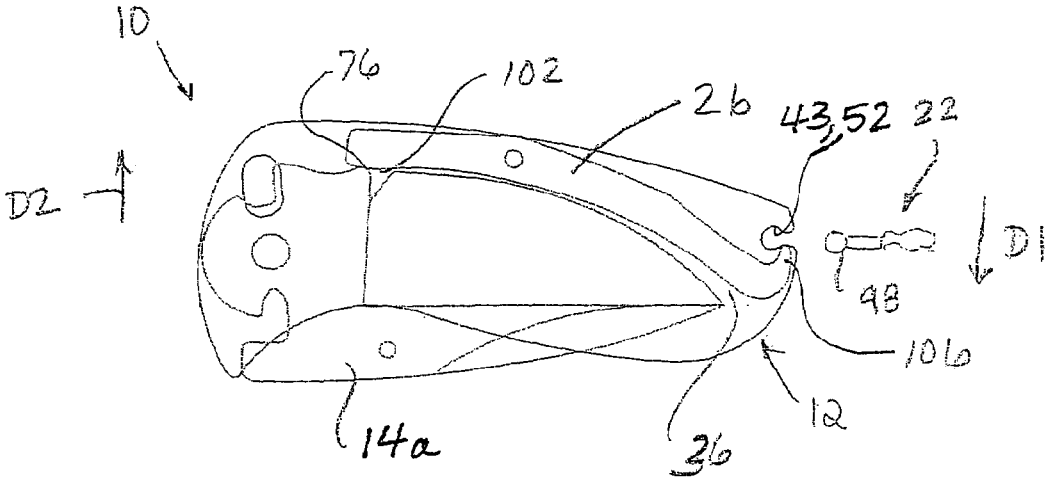
FIG. 4 is a side view of the knife of FIG. 1A, wherein the blade is in a lanyard release position, the lanyard locking arm is in an unlocked position, the lanyard is detached from the knife; also various portions of the knife are removed for clarity.

Referring first to FIGS. 1 and 1A, there is illustrated a first preferred embodiment of the present invention which comprises a folding knife indicated generally by reference numeral 10. Folding knife 10 includes a handle 12 and a blade 14 pivotally joined together by a blade coupling 16. Knife 10 further includes a blade locking arm 18 pivotally coupled to the handle 12 by a locking arm coupling 20. In addition, the knife 10 includes a lanyard 22 releasably coupled to the handle 12 and a lanyard locking arm 26 for selectively releasing the lanyard 22 from engagement with the handle 12. The lanyard locking arm 26 is also pivotally coupled to the handle 12 via the locking arm coupling 20. The knife 10 also has a spring 30 for biasing both the blade locking arm 18 and the lanyard locking arm 26, as discussed below.

By way of introduction, a general description of the operation of the knife 10 will be discussed first. Then, the structure of the knife 10 will be set forth in detail. Finally, the operation of the present invention will be described in detail, and subsequently alternate embodiments will be discussed.

As shown in FIGS. 1 and 1A, the blade 14 can be in an initial closed position so that the knife 10 can be safely stored on a user, either attached to a belt loop or carabiner or located in a pocket, bag or the like. In the initial closed position, there is no external force on the blade to move it. When a user desires to open the blade 14 for use, the blade 14 is rotated in a first direction R1 through a partially-open position (shown in FIG. 2) to a fully-open position (shown in FIG. 3). The blade locking arm 18 automatically locks the blade 14 in the fully-open position. In order to unlock the blade 14, the blade locking arm 18 is rotated in the direction R1. The blade 14 can then be rotated in a direction R2 back into the initial closed position (shown in FIG. 1).

Referring to FIGS. 1A and 4, the lanyard 22 and the lanyard locking arm 26 will be generally discussed. In FIG. 1A the lanyard locking arm 26 is in a locked position with the lanyard 22 coupled to the handle 12. In order to separate the lanyard 22 from the handle 12, the user need only squeeze the blade 14 to move it in the direction R2 from the initial closed position to an inward closed position. This causes the blade 14 to act on or pivot the lanyard locking arm 26 to an open position. Thereafter, the lanyard 22 may be separated from the handle 12 (as shown in FIG. 4) by pulling the handle 12 away from the lanyard 22, by pulling the lanyard 22 away from the handle 12 or by pulling the handle 12 and lanyard 22 away from one another.

Figure 5:
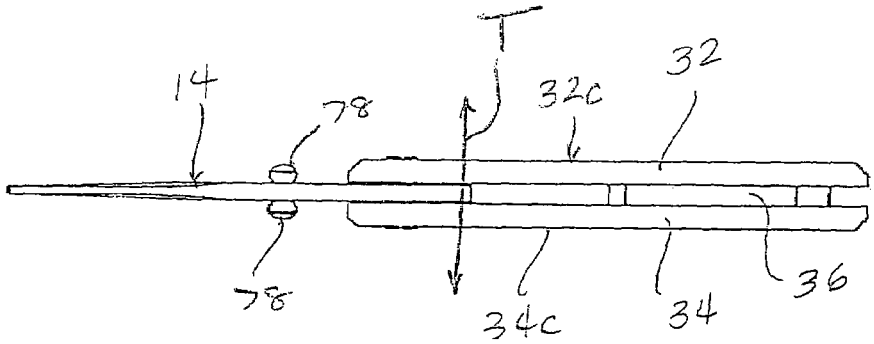
FIG. 5 is a top view of the knife of FIG. 1, wherein the blade is in the fully-open position and various portions of the knife are removed for clarity.

The specific configuration of the components of the knife 10 that allow it to operate, as briefly discussed above, will now be discussed. Referring to FIGS. 1A and 5, knife 10 has a longitudinal axis L, a vertical axis V and a transverse axis T that are orthogonal to one another.

Referring to FIGS. 1, 1A, 5, and 6–7, the handle 12 includes a first panel 32 and a second panel 34. The first and second panels 32 and 34 are joined together by the blade coupling 16 and a pair of suitable fasteners 35. The panels 32 and 34 when joined define a blade cavity 36 therebetween for receiving a portion of the blade 14 in the initial closed position, as shown in FIG. 1. The handle 12 further includes a first margin M1 and a second margin M2. In the initial closed position, the blade 14 extends from the second margin M2 and the blade locking arm 18 is adjacent the first margin M1. The second margin M2 is in the blade cutting path. The first margin M1 is spaced therefrom.

Figure 6:
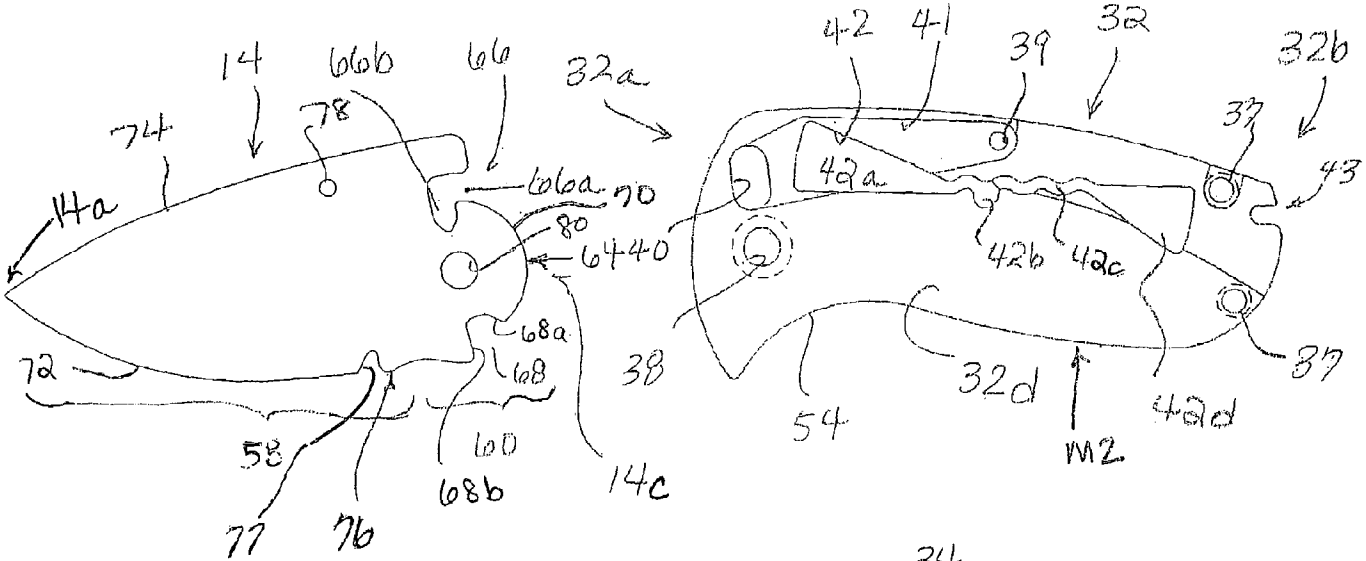
FIG. 6 is an exploded, side view of the blade and a first panel of a handle of used in the knife of FIG. 1.

With reference to FIGS. 1 and 5–6, the first panel 32 includes a front end 32*a*, a rear end 32*b*, an outer surface 32*c*, and an inner surface 32*d*. The first panel 32 defines a pair of fastener bores 37 therethrough for receiving fasteners 35, a blade coupling bore 38 therethrough for receiving the blade coupling 16, and a locking arm coupling bore 39 therethrough for receiving the locking arm coupling 20. In addition, the first panel 32 defines a knob bore 40 therethrough.

Figure 7:
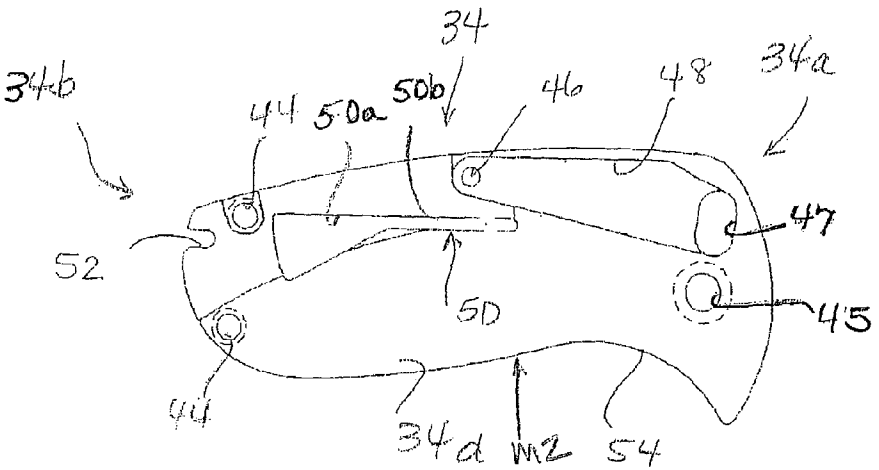
FIG. 7 is a side view of a second panel of the handle used in the knife of FIG. 1.
Figure 7A:
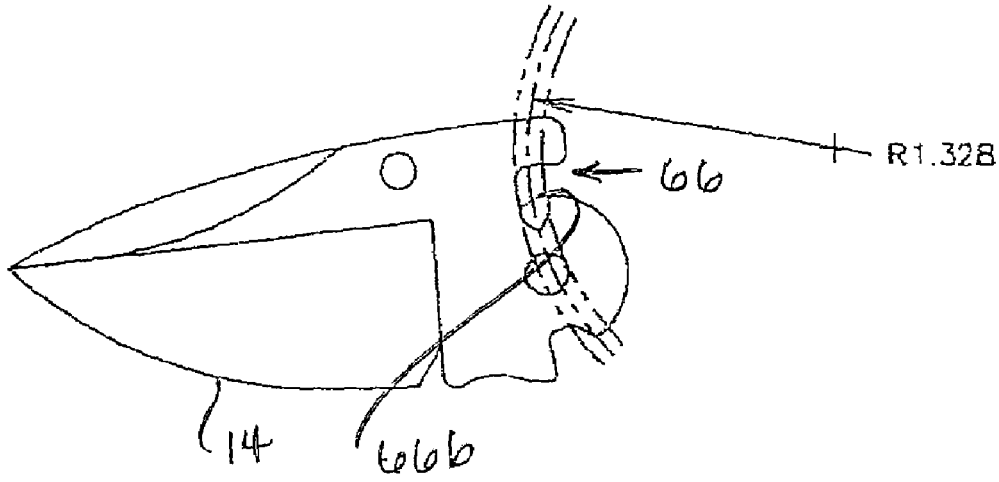
FIG. 7A is a side view of the blade of FIG. 6 showing a curvature on a locking recess.
Figure 7B:
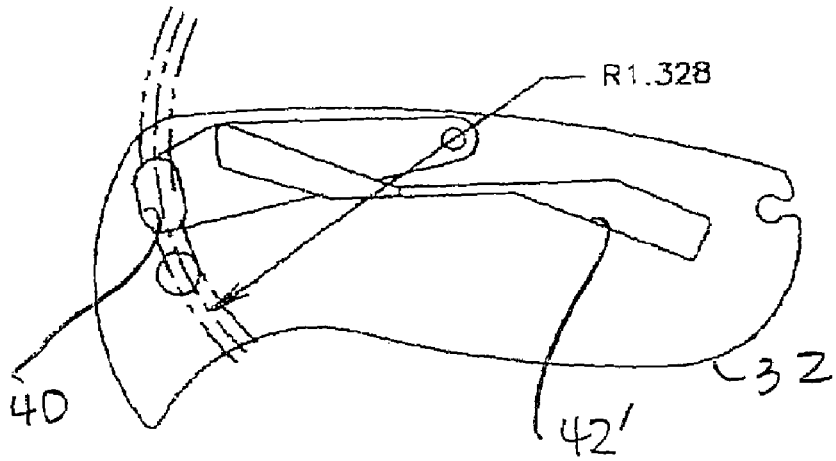
FIG. 7B is a side view of the first panel of FIG. 6 showing a curvature on a knob bore.

Referring to FIG. 7B, knob bore 40 is curved to follow the path of the end of the blade locking arm 18 (see FIG. 1) as it pivots. This allows the handle panel 32 to take the locking load from the blade 14 should the locking arm 18 fail. Alternatively, the knob bore can have another shape, such as straight.

Turning again to FIG. 6, the inner surface 32*d* of the panel 32 defines a first locking arm recess 41 and a first spring recess 42. First locking arm recess 41 is configured and dimensioned to allow blade locking arm 18 to pivot therein. The first spring recess 42 has a first section 42*a*, a second section 42*b*, a third section 42*c*, and a fourth section 42*d*. The first and fourth sections 42*a* and 42*d* are enlarged to allow movement of the spring 30 (see FIG. 1A) therein. The second section 42*b* is substantially circular to retain a portion of the spring 30 therein. The third section 42*c* is wavy to retain spring 30 within cavity 42 during assembly of the knife. The third section 42*c* is optional. The present invention is not limited to the shape of first locking arm recess 41 and first spring recess 42. FIG. 7B shows an example of an alternatively shaped spring recess 42'.

Referring to FIGS. 1A and 6, the rear end 32*b* of the panel 32 further defines an open-ended cutout 43 for receiving a portion of lanyard 22.

With reference to FIGS. 1 and 5–7, the second panel 34 includes a front end 34*a*, a rear end 34*b*, an outer surface 34*c*, and an inner surface 34*d*. The outer surfaces 32*c* and 34*c* are contactable by a user's hand. The second panel 34 defines a pair of fastener bores 44 therethrough for receiving fasteners 35, a blade coupling bore 45 therethrough for receiving the blade coupling 16, and a locking arm coupling bore 46 therethrough for receiving the locking arm coupling 20, in addition, the second panel 34 defines an arcuate knob bore 47 therethrough. Preferably but optionally, bore 47 is curved similar to bore 40 (shown in FIG. 7B). The bores 44, 45, 46, and 47 are configured, dimensioned, and located to be aligned with associated bores 37, 38, 39, and 40, respectively.

The inner surface 34*d* of the panel 34 defines a second locking arm recess 48 and a second spring recess 50. The second spring recess 50 has a first section 50*a* and a second section 50*b*. The first section 50*a* is enlarged to allow movement of the spring 30 therein. The first section 50*a* is configured, dimensioned, and located to be aligned with associated first section 42*a* of recess 42 in first panel 32. The second section 50*b* extends longitudinally and secures a portion of the spring 30 therein. The present invention is not limited to the shape of second locking arm recess 48 and second spring recess 50.

Referring to FIGS. 1A and 6–7, the rear end 34*b* of the panel 34 further defines an open-ended cutout 52 for receiving a portion of lanyard 22. The cutout 52 is configured, dimensioned, and located to be aligned with cutout 43 in first panel 32.

With reference to FIGS. 6 and 7, the second margin M2 of each panel 32 and 34 has a matching curved section 54 for allowing a portion of the blade 14 to extend out of the handle 12, when in the initial closed position, as shown in FIG. 1.

The handle panels 32 and 34 are preferably made of conventional materials, such as metal, plastic, or composite materials (e.g., fibers impregnated with resin) using conventional techniques. Although a spacer, as known by those of ordinary skill in the art, is not used herein it can be used, if the lanyard locking arm 26 is not used herein.

As is customary in folding knives, blade 14 is an integral structure, which is elongated and relatively narrow. Referring again to FIG. 6, the blade 14 includes a front end or pointed tip 14*b* and a rear end 14*c*. Between ends 14*b* and 14*c*, blade 14 can be conceptually divided into two portions, a working portion indicated generally by reference numeral 58, and a tang indicated generally by reference numeral 60. Working portion 58 of blade 14 is conventional and need not be described in detail. As is known in the art, folding knife blades come in an endless variety of shapes and sizes, many of which can be used in conjunction with the present invention.

Tang 60 includes a rear edge 64 that defines a locking recess 66, a retention recess 68, and a gliding edge portion 70 between recesses 66 and 68. Locking recess 66 has a horizontal section 66*a* and an arcuate vertical section 66*b* so that the recess 66 is generally L-shaped.

Referring to FIG. 7A, vertical section 66*b* of locking recess 66 is curved to follow the path of the end of the blade locking arm 18 (see FIG. 1) as it pivots. This allows locking arm 18 to move smoothly and prevents blade locking arm once locked, from moving vertically without the user unlocking the knife.

Retention recess 68 has two surfaces: a retention surface 68*a* and a vertical stopping surface 68*b* so that the recess 68 is generally U-shaped. Retention surface 68*a* provides some resistant to the opening of the blade 14 from the closed position, but is not a positive lock. Surface 68*a* is also formed to allow a user to smoothly open the blade 14. Alternatively, the retention surface 68*a* can be formed to be parallel to stopping surface 68*b*. As a result, the alternative retention surface 68*a* would provide a positive locking surface for the blade 14 in the closed position.

The blade 14 further includes a cutting edge 72, a blunt edge 74 opposite the cutting edge 72, a curved cam surface 76 between the cutting edge 72 and the tang 60, and a pair of rounded protrusions 78 (as best seen in FIG. 5). The cutting edge 72 is sufficiently sharp to cut various materials as desired by a user. The blunt edge 74 is dull and/or flat. The function of the cam surface 76 will be discussed below with respect to the operation of the knife 10.

Blade 14 further includes a notch 77 and protrusions 78. Notch 77 is adjacent cam surface 76 for edging purposes and is optional. Protrusions 78 may be provided on opposite sides of blade 14 to facilitate user manipulation of blade 14. Alternatively, the protrusions 78 may be replaced with various conventional opening aids such as a notch, bore or the like. The blade 14 also defines a coupling bore 80 for receiving the blade coupling 16 (as shown in FIG. 1).

Referring to FIGS. 1, 6, and 7, the blade coupling 16 passes through bores 38 and 45 of panels 32 and 34, respectively, and bore 80 in blade 14. The preferred embodiment of blade coupling 6 comprises a suitable nut and screw assembly or the like, as is conventional and known by those of ordinary skill in the art.

Figure 8C:
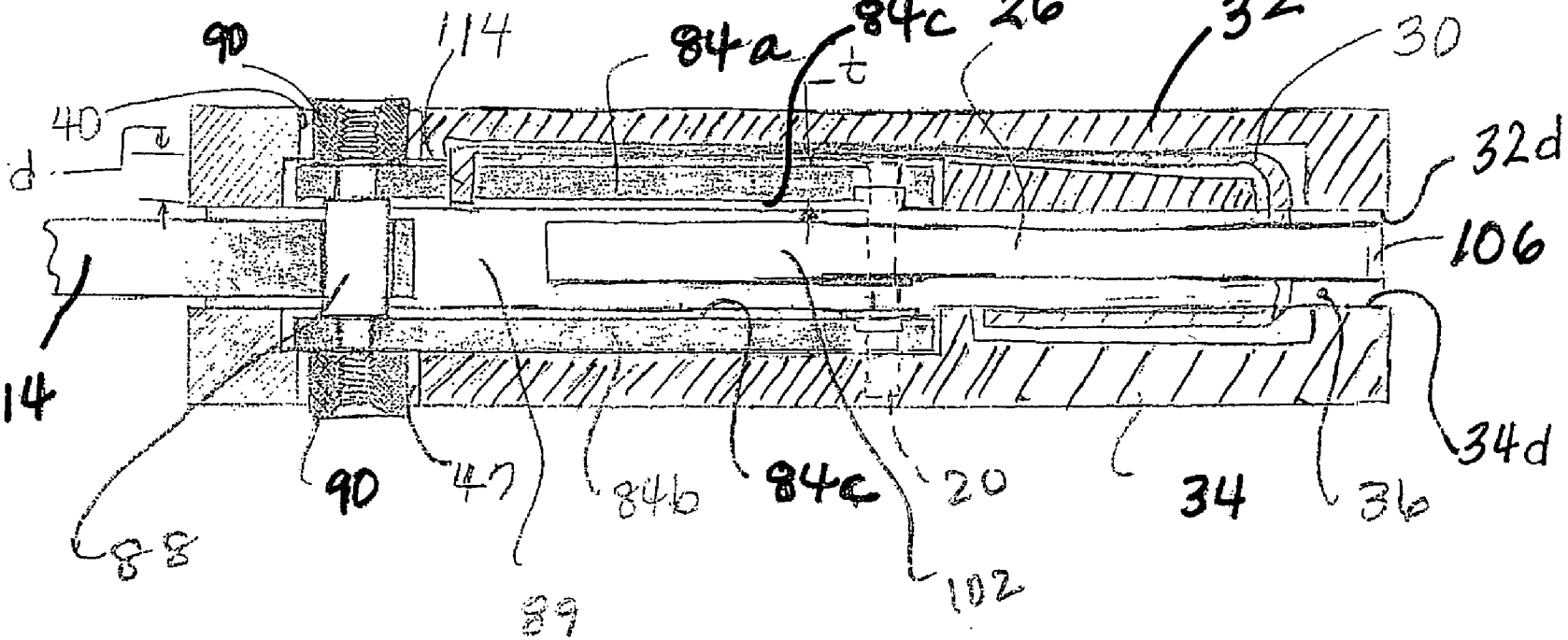
FIG. 8C is an enlarged, top view of a portion of the knife of FIG. 1.

Referring to FIGS. 8A–8C and 9, the blade locking arm 18 is an assembly that includes a pair of first members 84*a,b* that extend longitudinally. Each of the first members 84*a,b* define a knob bore 85 and a coupling bore 86. Member 84*a* further includes a spring bore 87. Locking arm 18 further includes a second member 88. When the first members 84*a,b* are joined together by the second member 88, a locking arm cavity 89 is formed therebetween. Also, when locking arm 18 is installed, a portion of blade 14 is disposed within locking arm cavity 89 (as best seen in FIG. 8C). When the locking arm 18 is installed in the handle 12, the second member 88 extends transversely across the blade cavity 36. The second member 88 is stepped to limit transverse movement of the first members 84*a,b* thereon. The free ends of the second member 88 are capped with knobs 90. The present invention is not limited to the shape of the first members 84*a,b* shown herein and alternative shapes may be used. The second member 88 may be made wear resistant by using, for example, a coating.

Referring to FIGS. 6–7, and 8A–8C the first members 84*a,b* and recesses 41 and 48 in first and second handle panels 32 and 34, respectively, are configured and dimensioned so that when the locking arm 18 is installed within the handle 12, the first members 84*a,b* are received by recesses 41 and 48. The configuration locates the first members 84*a,b* outside of the blade cavity 36, as shown in FIG. 8C. More preferably, the depth d of the recesses 41 and 48 is slightly greater than the thickness t, as shown in FIG. 8C, thereby increasing the available volume of the blade cavity 36 over prior art knives. Preferably, the recesses 41 and 48 and first members 84*a,b* are configured and dimensioned so that the inner surfaces 84*c* of the first members are below or flush with the inner surfaces 32*d* and 34*d* of panels 32, 34. Alternatively, the members 84*a,b* may be raised slightly above inner surfaces 32*d* and 34*d* of panels 32, 34.

With continued reference to FIG. 8C, when the locking arm 18 is installed within handle 12, the knobs 90 extend through bores 40 and 47 of handle panels 32 and 34, respectively. Thus, knobs 90 are adjacent first margin M1 of handle 12 (see FIG. 1). Preferably, knobs 90 are provided on opposite sides of knife 10 to facilitate user manipulation of blade 14 with either the right-hand or the left hand. The knobs 90 are completely surrounded by the panels 32 and 34, however the knobs 90 need not be completely surrounded by panels 32, 34. More preferably, turning to FIGS. 1 and 6–7, the bores 40 and 47 and the knobs 90 are adjacent the blade coupling 16 opposite the blade 14 so that the knife 10 can be manipulated with one hand, while that hand is spaced from the blade path adjacent second margin M2.

Referring again to FIGS. 1A and 6–9, the locking arm 18 is pivotally coupled to the handle 12 by disposing a locking arm coupling 20 through bores 39 and 46 in panels 32 and 34, respectively, and through coupling bore 86 in locking arm 18. By having a pivotal locking arm 18, any force on the blade 14 that attempts to close the blade 14 without unlocking the locking arm 18 is transferred in turn to the second member 88, the handle panels 32 and 34, and the locking arm coupling 20. As a result, knife 10 does not require a conventional stop pin for limiting rotation of the blade. In a preferred embodiment, the coupling 20 is a pin transversing the blade cavity 36, as shown in FIG. 8C, but alternatively the coupling 20 can be a pair of shoulder screws (as later discussed).

Referring to FIG. 9, the spring bore 87 acts as a spring coupling for connecting spring 30 (as shown in FIG. 1A) to locking arm 18. In an alternative embodiment, the spring coupling may include a projection contacted by the spring. By way of example, the spring 30 may also be coupled to the locking arm 18 by disposing the spring above the locking arm 18 to rest thereon. The present invention is not limited to these couplings and any arrangement that allows the spring to bias the locking arm 18 may be used.

Referring to FIGS. 1 and 8A, the blade 14 is preferably made of conventional materials, such as metal or ceramic using conventional techniques. Blade locking arm 18 is preferably formed of metal. Preferably, first members 84*a,b* are formed of sheet metal. Although the locking arm 18 is shown with two first members 84*a,b*, the locking arm 18 may include a single first member. Additionally, the locking arm 18 can be formed as an integral structure so that the first members are formed of a single piece of sheet metal bent into a generally U-shape. Then, the member 88 can be connected thereto.

Figure 10:
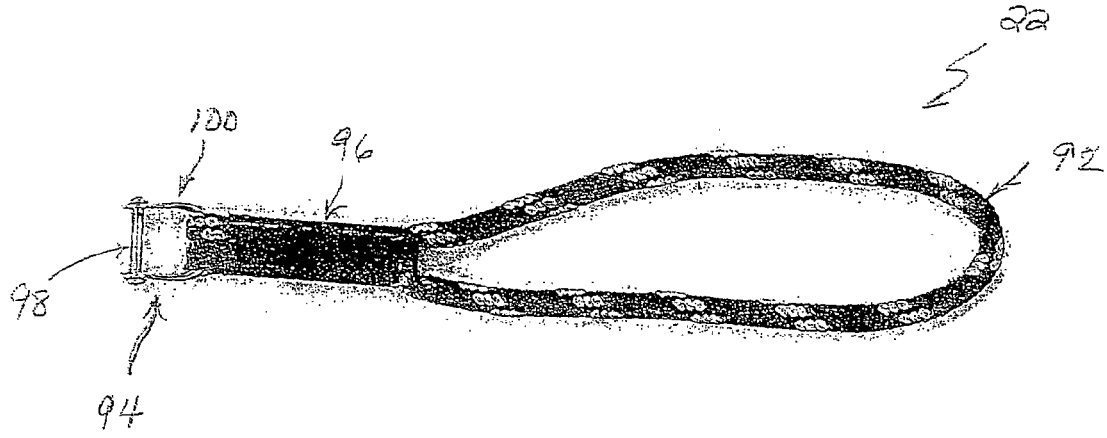
FIG. 10 is an enlarged, top view of the lanyard of FIG. 1A.

Now turning to FIG. 10, a lanyard 22 is shown. The lanyard 22 includes a piece of rope 92 wrapped about a lanyard shackle or coupling 94 and secured thereto by a band 96. The integrally formed commercially available lanyard coupling 94 of metal includes a pin 98 and a curved portion 100. The pin 98 is configured and dimensioned to be received within the cutouts 43 and 52 of panels 32 and 34, respectively, as shown in FIGS. 10, and 6–7. The present invention is not limited to this lanyard configuration.

Figure 11:
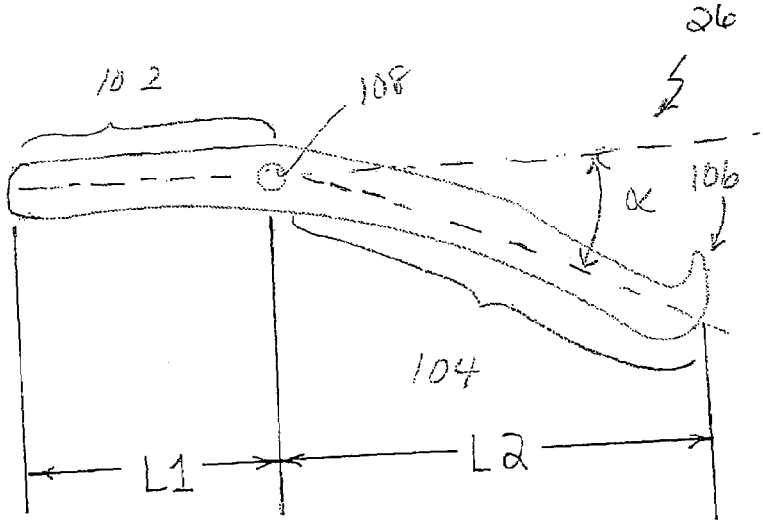
FIG. 11 is an enlarged, side view of the lanyard locking arm.

Referring to FIG. 11, the lanyard locking arm 26 includes a first portion 102 and a second portion 104 angularly offset from the first portion at an angle $\alpha$. The angle $\alpha$ depends on the shape of the handle 12. Between first portion 102 and second portion 104, the lanyard locking arm 26 defines a locking arm coupling bore 108. When the locking arm 26 is coupled to the handle 12, the bore 108 is the location of the fulcrum and the locking arm 26 pivots about this location. The length L1 of the first portion and the length L2 of the second portion 104 determine the location of the bore 108. The lengths L1 and L2 are selected to allow the blade 14 to rotate and contact locking arm 26 sufficiently to rotate arm 106 downward to release lanyard 22.

With reference to FIGS. 1A, 8C, and 11, when the lanyard locking arm 26 is installed within the knife 10, the first portion 102 of the arm 26 extends within the locking arm cavity 89 between first members 84*a,b* of locking arm 18. The second portion 104 of the lanyard locking arm 26 is disposed within the blade cavity 36. The lanyard locking arm 26 is pivotally coupled to the handle panels 32 and 34 by disposing locking arm coupling 20 through the bore 108. In the present embodiment, the locking arm coupling 20 pivotally couples the blade locking arm 18 and the lanyard locking arm 26 to the handle 12. In an alternative, embodiment two separate locking arm couplings can be used. For example, if shoulder screws are used to couple the blade locking arm 18 to the handle 12, a pin such as coupling 20 can be used to couple lanyard locking arm 26 to the handle 12.

Figure 12:
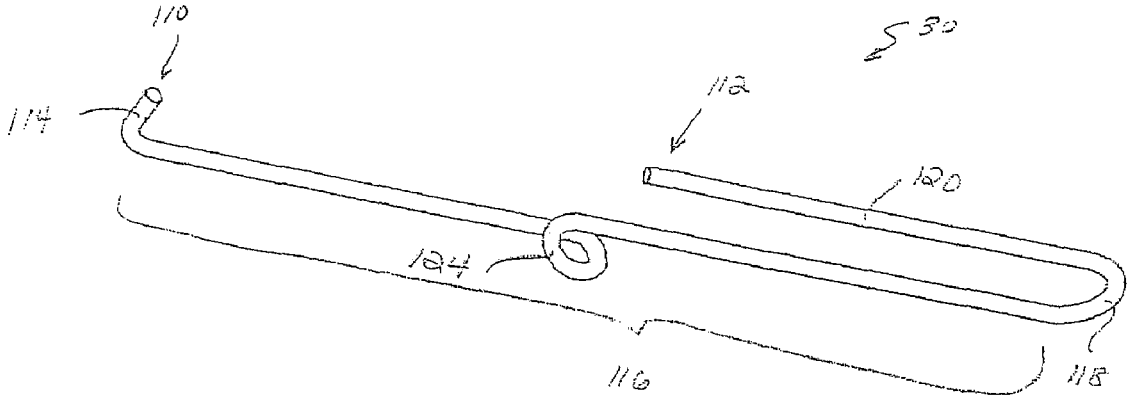
FIG. 12 is an enlarged, perspective view of a spring used in the knife of FIG. 1.

Referring to FIG. 12, spring 30 is shown. Spring 30 includes a first end 110, a second end 112 and first, second, third, and fourth portions 114, 116, 118, and 120 between the ends 110 and 112. The first portion 114 is angularly offset from second portion 116 so that portion 114 extends transversely across knife 10, as shown in FIG. 8C. Referring to FIGS. 8C–9, and 12, first portion 114 engages spring bore 87 of first member 84*a*. The second portion 116 includes a curved central portion 124. Third portion 118 is arcuate and joins second portion 116 with fourth portion 120. Consequently, the majority of the length (i.e., second portion 116 and fourth portion 120) of the spring 30 is recessed from and outside of blade cavity 36 (shown in FIG. 5).

The spring 30 is received within cavities 42 and 50 of handle panels 32 and 34, respectively, as shown in FIGS. 6–7. The spring recess 42 is deeper than the locking arm recess 41 so that the spring 30 retained therein is sandwiched between the first member 84*a* and the panel 32 (see FIG. 8C). First portion 114 is free to move vertically within enlarged section 42*a*. Second portion 116 is received within section 42*a–d* so that curved portion 124 is within section 42*b*. Third portion 118 is free to move within sections 42*d* and 50*a*. Fourth portion 120 is located within section 50*b*. The curved portion 124 allows the spring 30 to be easily located and retained during assembly. The curved portion 124 also allows the portions 118 and 120 to be transversely offset to contact locking arm and panel 34, respectively. Alternatively, the spring 30 may include a bent section instead of curved portion 124 to offset spring 30. In another embodiment, spring 30 may be replaced with two separate springs, one for biasing the blade locking arm 18 and the other for biasing the lanyard locking arm 26. The spring or springs used herein may be flat, coiled, plastic, elastomeric or the like so long as they provide the spring force necessary to bias the arms 18 and 26.

The spring 30 is shown in FIG. 12 in its unstressed state. When the spring 30 is inserted into the knife 10, (see FIGS. 1A, 11 and 12) it is bent and stressed so that portion 114 bias second member 88 of blade locking arm 18 downward into contact with blade 14 and curved end 118 biases second end 104 of lanyard locking arm 26 upward.

The operation of the blade locking and unlocking features of the preferred embodiment of the present invention will now be described with reference to FIGS. 1–6 and 8A–8C. Initially, knife 10 is in a folded state where the blade 14 is in the initial closed position (see in FIG. 1). The cutting edge 72 of blade 14 is tucked away safely within blade cavity 36 of handle 12.

As aforementioned, first portion 114 of spring 30 is stressed to downwardly bias in direction D1, so that second member 88 of blade locking arm 18 is biased toward tang 60 of blade. In the initial closed position, second member 88 is within retention recess 68 of blade 14. As a result, more than vibration or a casual force rotating blade 12 is necessary for second member 88 to ride up on surface 68*a* (as shown in FIG. 6) out of retention recess 68. In other words, knife 10 is forcibly constrained, but not positively locked in the initial closed position. The user contacts projections 78 of blade 14, and rotates blade 14 in the clockwise direction R1 through the partially-open position (shown in FIG. 2) and into the fully-open position (shown in FIG. 3). In the partially-open state, the blade locking arm 18 pivots and second member 88 of blade locking arm 18 rides on the gliding edge 70 of blade 14. The sliding friction between second member 88 and gliding edge 70 and force of member 88 on edge 70 principally hinders movement of blade 14 from the closed to open positions and vice versa. This prevents blade 14 from swinging freely open or closed. The rotation R1 can be achieved with a single hand of a user, if desired.

Referring to FIGS. 6 and 8B, when second member 88 of blade locking arm 18 is within horizontal portion 66*a* of locking recess 66 and aligned with vertical portion 66*b* of locking recess 66, the bias of spring 30 automatically moves second member 88 into portion 66*b*. Thus, positively locking blade 14 in the open position (see FIG. 3). The result is that blade 14 is effectively prevented from closing accidentally onto the fingers of the user.

FIG. 3 shows blade 14 in its fully opened state. In order to close the knife 10, the user can use a thumb to pivot knob 90 in direction D2. The knob 90 used depends on whether the user is right-handed or left-handed. Once the second member 88 of the locking arm 18 is moved out of the vertical portion 66*b* of the locking recess 66 (as shown in FIG. 6), the user can use another finger such as the index finger to rotate the blade 14 in direction R2. Any of the remaining fingers other than the thumb can also be used to rotate the blade 14 closed. Thus, a single hand can be used to unlock and close the knife while keeping such hand away from the blade path. As a result, the user has unlocked the blade locking arm 18 and the blade 14 rotates through the partially-open position (shown in FIG. 2) back to the initial closed position (shown in FIG. 1). In the partially-open state, the blade locking arm 18 pivots and second member 88 of blade locking arm 18 rides on the gliding edge 70 of blade 14. Again, the sliding friction between second member 88 and gliding edge 70 and force of member 88 on edge 70 principally hinders movement of blade 14 from the closed to open positions and vice versa. This prevents blade 14 from swinging freely open or closed.

The operation of the lanyard locking and unlocking features of the preferred embodiment of the present invention will now be described with reference to FIGS. 1A, 4, 6–7 and 10–11. In FIG. 1A, the knife 10 is shown in its closed or folded state with the lanyard 22 coupled to the knife and lanyard locking arm in a locked position. A user may have the lanyard 22 connected to a belt loop, bag, backpack, carabineer, or the like. If the knife 10 is attached to such a component, using the knife may be difficult. Thus, the user may want to separate the knife 10 from the lanyard 22 to allow easy use of the knife 10. In the lanyard 22 assembled in the knife 10, shown in FIG. 1A, the pin 98 of lanyard coupling 94 is within cutouts 43 and 52 of handle panels 32 and 34, respectively. The pin 98 is secured within cutouts 43 and 52 via locking portion 106 that closes cutouts 43 and 52 to retain lanyard 22 therein. Curved portion 118 of spring 30 is in contact with second portion 104 of locking arm 26 and biases locking portion 106 in direction D2 into the lanyard locked position.

In order to separate the knife 10 from lanyard 22, the user applies a force to blunt edge 74 of blade 14 to rotate blade 14 in direction R2 into an inward closed position, shown in FIG. 4. As a result, blade 14 has moved inward further into blade cavity 36. As a result, cam surface 76 contacts first portion 102 of locking arm 26, pivots locking arm 26. This moves first portion 102 in direction D2 and locking portion 106 in direction D1. When the locking portion 106 is out of alignment with the cutouts 43, 52 (as shown in FIG. 4), the lanyard locking arm is in an unlocked position and the handle 12 may be separated from lanyard 22. The force necessary to unlock lanyard 22 may be applied by a user grasping and squeezing blade further into cavity 36 in a natural fashion. When the user releases the blade 14, spring 30 specifically portion 118 (shown in FIG. 11) automatically biases second portion 104 of locking arm 26 in direction D2 and into the locked position. Due to the spring force and interaction between the locking arm 26 and blade 14, blade 14 moves from the inward closed position to the initial closed position automatically.

Referring to FIGS. 1A and 6, surface 68*b* is formed to stop rotation of the blade 14 in direction R2, when the knife 10 is squeezed. As a result, the cutting edge 72 does not contact components, such as the lanyard locking arm 26 or spring 30. Such contact would dull the cutting surface.

Referring to FIG. 4, in order for a user to reconnect the handle 12 and lanyard 22, the user must again unlock the locking arm 26 by moving the blade 14 inward so that the pin 98 can be relocated in cutouts 43, 52. Once the pin 98 is within cutouts 43, 52, the user can release the blade 14 and the locking arm 26 is biased by spring 30 (as shown in FIG. 12) back into the locked position where it secures lanyard 22 to handle 12, and blade 14 is biased back into the initial closed position.

Referring to FIGS. 1A and 6–7, according to one feature of the present invention, the blade locking arm 18 and blade locking recess 66 and retention recess 68 can be used in a knife without the lanyard locking arm 26. Alternatively, the lanyard locking arm 26 and lanyard 22 can be used in a knife without the blade locking arm 18.

Figure 13:
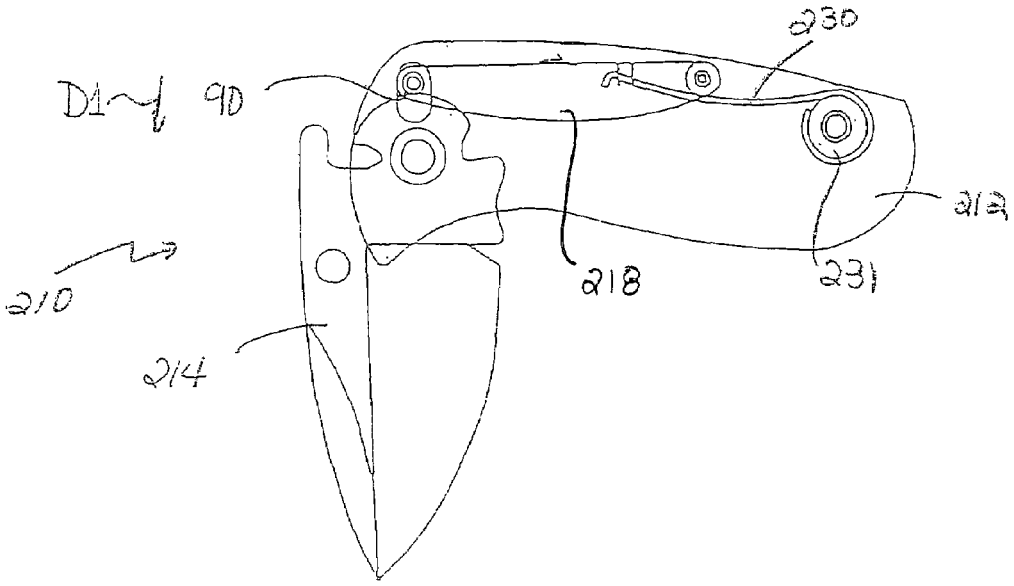
FIG. 13 is a side view of a preferred second embodiment of a knife of the present invention, wherein the blade is in a partially-open position.

FIG. 13 illustrates a second embodiment of a knife 210 of the present invention wherein. Referring to FIGS. 14–18, in the second embodiment the locking member 218 is an open frame and similar to locking member 18 and has first members 284*a,b* recessed within handle panels 232 and 234. As a result, locking arm 218 has a substantial portion is outside of blade cavity 236. Locking arm 218 is pivotally coupled to handle 212 via a locking arm coupling 220 in the form of a pin. First member 284*a* includes a spring attachment tab 287 for coupling spring 230 to locking arm 218. Second member 288 that contacts blade 214 and coupling 220 are the only portions of the locking arm 218 within blade cavity 236, best shown in FIG. 14.

Figure 14:
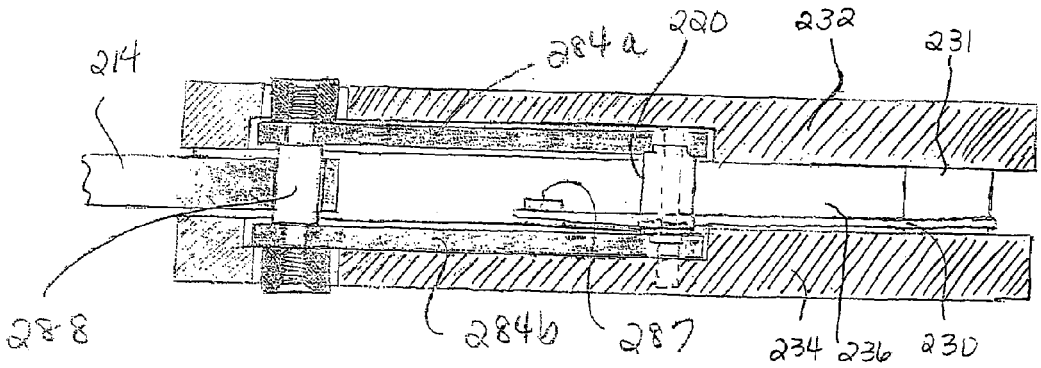
FIG. 14 is an enlarged, top view of a portion of the knife of FIG. 13.
Figure 19:
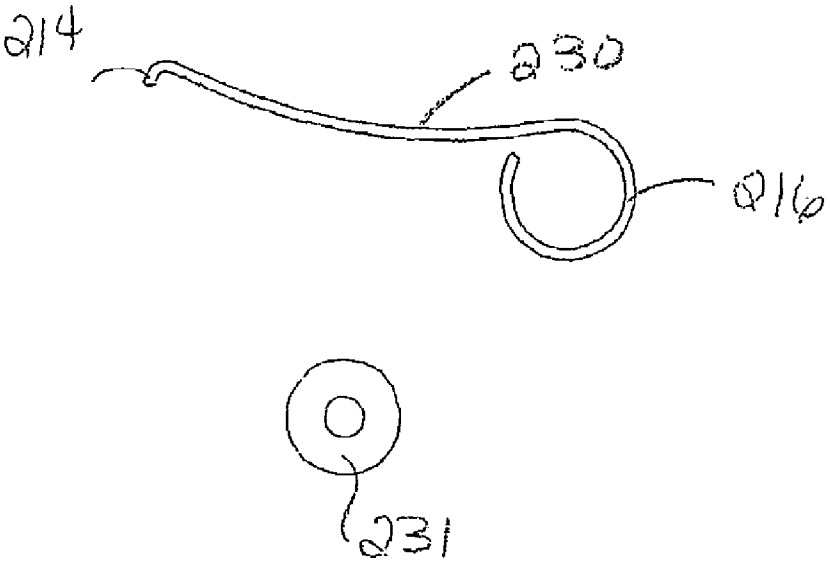
FIG. 19 is an enlarged, exploded side view of a spring and spring coupling used in the knife of FIG. 13.
Figure 18:
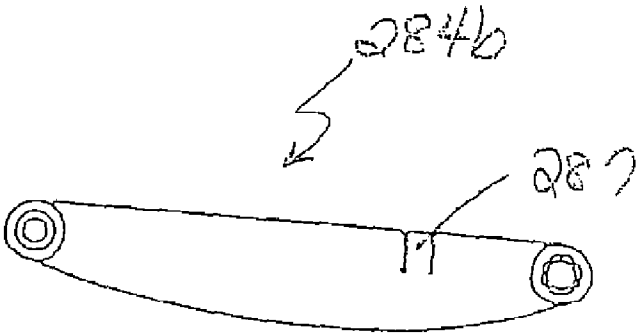
FIG. 18 is an enlarged, side view of a first member of the locking arm of FIG. 16.

Referring to FIGS. 14 and 19, spring 230 is within blade cavity 236 and has a first portion 214 and a second portion 216. First portion 214 contacts tab 287 of blade locking arm 218. Second portion 216 is wrapped about a spring coupling hub 231. The spring 230 is shaped to bias knobs 290 of locking arm 218 in direction D1, similar to knife 10. Knife 210 is operable similarly to knife 10 with respect to the blade locking and unlocking feature.

FIG. 20 illustrates a third embodiment of a knife 310 of the present invention wherein. Referring to FIGS. 20–22, in the third embodiment the locking member 318 is an open frame similar to locking member 218 and has first members 384*a,b* recessed within recesses 341 and 348 of handle panels 332 and 334, respectively. As a result, locking arm 318 has a substantial portion outside of blade cavity 336. Locking arm 318 is pivotally coupled to handle 312 via a locking arm coupling 320 in the form of a pair of shoulder screws. As a result, the shoulder screws are recessed out of blade cavity 336 also. With the use of shoulder screws, the orientation of the locking arm 318 can be changed as no portions of the locking arm 318 except the second member 288 are within the cavity 336. Thus, for example locking arm 319 (shown in phantom in FIG. 20 shows such an alternate orientation). Changing the locking arm orientation may also require relocation of the spring 330. First member 384*a* (see FIG. 22) includes a spring attachment bore 387 for coupling spring 230 to locking arm 218.

Referring to FIGS. 21 and 22, spring 330 is disposed within a spring recess 342 in panel 332. Spring recess 342 is deeper than recess 341 so that spring 330 is sandwiched between first member 384*a* and panel 332. As a result, spring 330 is outside of blade cavity 336. Spring 330 has a first portion 314 and a second portion 316. First portion 314 contacts bore 387 of blade locking arm 384*a*. Second portion 316 is disposed within a bore (not shown) in panel 332 to secure spring 330 thereto. The spring 330 is shaped to bias knobs 390 of locking arm 318 in direction D1, similar to knife 10. Knife 310 is operable similarly to knife 10 with respect to the blade locking and unlocking feature.

Lanyard 22 and lanyard locking arm 26 (as shown in FIG. 1A) can be used with the knife 310 with modifications to knife 310 as necessary and shown in knife 10.

Knives according to the present invention provide a blade cavity for accepting larger blades and if desired a lanyard locking arm. In such knives, a blade locking arm is provided for positively locking the blade in the open position. Additionally, the knife is operable by left and right handed users and operable with a single hand. Moreover, operation of the blade can be achieved while keeping the fingers out of the blade path since the blade locking arm knobs are near the pivotal connection of the blade to the handle opposite when the blade enters the handle. Preferably, the knife is also configured so that the blade is releasably retained in the closed position. The present invention also provides a knife having a releasable lanyard configured so that a user grasping the knife and squeezing the blade inward easily releases the knife from the lanyard. Consequently, the knife can be carried without the users hands and released from the lanyard with a single hand. It is clear from the above that the objects of the invention have been fulfilled.

Those skilled in the art will appreciate that the conception, upon which this disclosure is based, may readily be utilized as a basis for designing other products for carrying out the several purposes of the present invention. It is important, therefore, that the claims be regarded as including such equivalent constructions and modifications insofar as they do not depart from the spirit and scope of the present invention as defined in the appended claims.

Therefore, this invention is not to be limited to the specifically preferred embodiments depicted herein. For example, the features of one embodiment disclosed above can be used with the features of another embodiment. Alternatively, the lanyard and lanyard locking arm can be incorporated into knives with other types of locking mechanisms, such as liner locks and conventional lock backs. The invention is a folding knife with an open frame blade locking arm. Additionally or alternatively, the inventive folding knife includes lanyard and a lanyard locking arm. The lanyard locking arm is movable from a closed position to an open position by moving the blade inward into the blade cavity. Thus, the details of these components as set forth in the above-described preferred embodiment, should not limit the scope of the present invention.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim:

1. A folding knife, comprising:

a handle defining a blade cavity therein, wherein said handle includes first and second panels with first and second recesses, respectively;

a blade pivotally joined to said handle and movable between a fully-open position and an initial closed position, said blade including a rear edge with a locking recess;

a blade locking arm including a pair of first members spaced apart to define a locking arm cavity therebetween, a portion of said blade being disposed within said locking arm cavity, and said blade locking arm further including a second member being disposed between and coupled to said pair of first members, said first members being pivotally joined to the handle, wherein said first and second recesses of said handle are configured and dimensioned to receive a substantial portion of at least one of said first members so that said substantial portion of each of said first members is outside of said blade cavity; and a spring coupled to said handle, said spring biasing said second member of said blade locking arm into contact with said rear edge of said blade, wherein when said blade is pivoted into the fully-open position, said second member is disposed within said locking recess.

2. The folding knife of claim 1, wherein said first and second panels further include first and second bores, respectively, therethrough, and said blade locking arm further includes a pair of knobs coupled to said first panels and extending outwardly therefrom through each associated bore.

3. The folding knife of claim 2, wherein said handle further includes a first margin and a second margin, in said initial closed position said blade extends from said second margin, and said knobs are adjacent said first margin.

4. A folding knife comprising:

a handle defining a blade cavity therein;

a blade pivotally joined to said handle and movable between a fully-open position and an initial closed position, said blade including a rear edge with a locking recess;

a blade locking arm including a pair of first members spaced apart to define a locking arm cavity therebetween, a portion of said blade being disposed within said locking arm cavity, and said blade locking arm further including a second member being disposed between and coupled to said pair of first members, said first members being pivotally joined to the handle;

a spring coupled to said handle, said spring biasing said second member of said blade locking arm into contact with said rear edge of said blade, wherein when said blade is pivoted into the fully-open position, said second member is disposed within said locking recess: and, a selectively releasable lanyard connected to a lanyard coupling and a lanyard locking arm pivotally coupled to said handle and disposed between said pair of first members, said lanyard locking arm having a first portion and a second portion, said second portion having a locking portion for retaining said lanyard coupling to said handle in a locked position, wherein upon moving said blade toward said locking arm said blade contacts said first portion of said locking arm and said lanyard locking arm pivots so that said locking portion pivots in a second direction opposite said first direction and said lanyard locking arm moves to an unlocked position where said lanyard coupling may separate from said handle.

5. The folding knife of claim 4, wherein said spring contacts said lanyard locking arm and biases said lanyard locking arm into said locked position.

6. The folding knife of claim 4, wherein said handle further includes a first panel and a spaced apart second panel joined thereto, said first panel further includes a first spring recess for receiving a portion of said spring and said second panel further includes a second spring recess for receiving another portion of said spring.

7. A folding knife comprising:

a handle defining a blade cavity therein;

a blade pivotally joined to said handle and movable between a fully-open position and an initial closed position, said blade including a cutting edge and a blunt edge, said cutting edge being within said blade cavity and said blunt edge being outside of said blade cavity in said initial closed position;

a selectively releasable lanyard connected to a lanyard coupling; and a lanyard locking arm pivotally coupled to said handle, disposed within said blade cavity, and movable between a locked position and an unlocked position, said lanyard locking arm having a first portion and a second portion, said second portion having a locking portion for retaining said lanyard coupling to said handle in said locked position, wherein upon moving said blade toward said lanyard locking arm said blade contacts said first portion of said lanyard locking arm, and said lanyard locking arm pivots to said unlocked position where said locking portion is spaced from said lanyard coupling and said lanyard coupling may separate from said handle.

8. The folding knife of claim 7, wherein moving said blade toward said lanyard locking arm occurs when a user squeezes the blade inwardly.

9. The folding knife of claim 7, further including a spring coupled to said handle, said spring biasing said second portion of said lanyard locking arm toward said locked position.

10. The folding knife of claim 9, wherein said spring bias causes said first portion of said lanyard locking arm to move into contact with said blade to move said blade into said initial closed position.

11. A folding knife, comprising:

a handle defining a blade cavity therein;

a blade pivotally joined to said handle, said blade including a rear edge with a locking recess;

a blade locking arm having a pair of spaced apart first members coupled to said handle and defining a locking arm cavity therebetween, and a second member extending between said first members and coupled thereto, when said blade is in a fully-open position, said second member is disposed within said blade locking recess to lock said blade;

a selectively releasable lanyard connected to a lanyard coupling; and a lanyard locking arm pivotally connected to said handle, said lanyard locking arm having a first portion and a second portion, said first portion being disposed within said locking arm cavity, and said second portion being disposed within said blade cavity and having a locking portion for retaining said lanyard coupling to said handle in a locked position, wherein upon moving said blade toward said lanyard locking arm said blade contacts said first portion of said lanyard locking arm, and said lanyard locking arm pivots to an unlocked position where said locking portion is spaced from said lanyard coupling and said lanyard coupling may separate from said handle.

12. The folding knife of claim 11, further including at least one spring for biasing said second member of said blade locking arm into contact with said blade.

13. The folding knife of claim 12, wherein said first members are pivotally coupled to said handle.

14. A folding knife, comprising:

a handle having first and second panels connected in a spaced apart arrangement to define a blade cavity therebetween, said first and second panels having first and second recesses, respectively;

a blade pivotally joined to said handle and movable between a fully-open position and an initial closed position, said blade including a rear edge with a locking recess;

a blade locking arm including a pair of first members spaced apart to define a locking arm cavity therebetween, and a second member being disposed between and coupled to said pair of first members, said first members being pivotally joined to the handle, said first and second recesses being configured and dimensioned to receive a substantial portion of at least one of said first members so that said substantial portion of each of said first members is outside of said blade cavity; and a spring coupled to said handle for biasing said second member of said blade locking arm into contact with said rear edge of said blade, wherein when said blade is pivoted into the fully-open position, said second member is disposed within said locking recess.

* * * * *